US005934088A

United States Patent [19]

Takeda

[11] Patent Number: 5,934,088

[45] Date of Patent: Aug. 10, 1999

[54] ERROR MONITORING APPARATUS IN REFRIGERATOR

[75] Inventor: Yukimasa Takeda, Nagoya, Japan

[73] Assignee: Hoshizaki Denki Kabushiki Kaisha, Aichi-ken, Japan

[21] Appl. No.: 08/921,580

[22] Filed: Sep. 2, 1997

[51] Int. Cl.[6] ..... F25B 49/02

[52] U.S. Cl. ..... 62/127; 62/129

[58] Field of Search ..... 62/127, 125, 126, 62/129, 130; 236/94; 165/11.1; 340/585, 588

[56] References Cited

U.S. PATENT DOCUMENTS 4,612,775 9/1986 Branz et al. ..... 62/126
4,615,179 10/1986 Chiu et al. ..... 62/129
5,262,758 11/1993 Nam et al. ..... 62/129 X

FOREIGN PATENT DOCUMENTS 5-45043 2/1993 Japan .
5-45045 2/1993 Japan .

*Primary Examiner*—Harry B. Tanner
*Attorney, Agent, or Firm*—Nikaido, Marmelstein, Murray & Oram LLP

[57] ABSTRACT

An error monitoring apparatus in a refrigerator including a plurality of sensors for detecting plural errors in the refrigerator and an indicator for displaying the detected errors, wherein the indicator is controlled to display the detected errors in a predetermined order of priority and is further controlled to successively switch over the display of the detected errors in the predetermined order of priority upon each operation of an error recognition switch.

3 Claims, 7 Drawing Sheets

Fig.3(A)

| |
|---|
| NER1 (0/1) |
| NER2 (0/1) |
| NER3 (0/1) |
| ⋮ |
| NERC (0/1) |

Fig.3(B)

| |
|---|
| OER1 (0/1) |
| OER2 (0/1) |
| OER3 (0/1) |
| ⋮ |
| OERC (0/1) |

Fig.3(C)

| |
|---|
| ERP1 (E5) |
| ERP2 (E3 |
| ERP3 ( ) |
| ⋮ |
| ERPC |

ERROR MONITORING APPARATUS IN REFRIGERATOR

BACKGROUND OF THE INVENTION

1. Field of the Invention

The present invention relates to an error monitoring apparatus in a refrigerator capable of informing a user or an inspector in charge for shipment of the occurrence of plural errors in the refrigerator by display of the same on an indicator.

2. Description of the Prior Art

There has been proposed an error monitoring apparatus in a refrigerator capable of informing a user or an inspector in charge for shipment of the occurrence of plural errors in the refrigerator by an alarm buzzer and display of the same on an indicator. Disclosed in Japanese Patent Laid-open Publication Nos. 5(1993)-45043 and 5(1993)-45045 is an error monitoring apparatus in a refrigerator wherein plural errors detected in the refrigerator are memorized in a memory and displayed on an indicator in the sequence of occurrence at each lapse of a predetermined time or at each operation of a detection switch.

In the former conventional error monitoring apparatus, the user or inspector turns off the power source switch of the refrigerator to be released from noisy alarm buzzer in the occurrence of errors. As in such an instance, the display of the detected errors disappears at the same time, it becomes difficult to confirm the errors detected in the refrigerator. Particularly, even if one of the errors displayed on the indicator is recognized, the other errors in the refrigerator may not be confirmed by the user or inspector. Although in the latter conventional error monitoring apparatus, the display of plural errors detected in the refrigerator is successively switched over, serious errors for operation of the refrigerator are displayed by the indicator in the same manner as the other minor errors. It is, therefore, impossible for the user or inspector to attend to eliminate the plural errors taking into account significance of the same.

SUMMARY OF THE INVENTION

In view of the problems discussed above, a primary object of the present invention is to provide an error monitoring apparatus in a refrigerator capable of displaying plural errors in the refrigerator in the order of priority determined taking into account significance of the errors.

According to the present invention, the object is accomplished by providing an error monitoring apparatus for a refrigerator including detection means for detecting plural errors in the refrigerator and indication means for displaying the detected errors, wherein the error monitoring apparatus comprises an error recognition switch for recognizing the errors detected by the detection means, first display control means for controlling the indication means to display the detected errors in a predetermined order of priority, and second display control means for controlling the indication means to successively switch over the display of the detected errors in the predetermined order of priority upon each operation of the error recognition switch.

In a practical embodiment of the present invention, it is preferable that the error monitoring apparatus further comprises means for prohibiting changeover of the display of the detected errors caused by the second display control means when predetermined kinds of errors in the detected errors are being displayed on the indication means.

According to an aspect of the present invention, there is provided an error monitoring apparatus in a refrigerator including detection means for detecting plural errors in the refrigerator, indication means for displaying the detected errors, and alarm means for generating an alarm buzzer when an error was detected by the detection means, wherein the error monitoring apparatus comprises an error recognition switch for recognizing the detected errors, first display control means for controlling the indication means to successively display the detected errors in a predetermined order of priority, alarm control means for deactivating the alarm means when the error recognition switch is turned on during generation of the alarm buzzer, and second display control means for controlling the indication means to successively switch over the display of the detected errors in the predetermined order of priority at each time when the error recognition switch is turned on during deactivation of the alarm means.

BRIEF DESCRIPTION OF THE DRAWINGS

Other objects, features and advantages of the present invention will be more readily appreciated from the following detailed description of a preferred embodiment thereof when taken together with the accompanying drawings, in which:

FIGS. 3(A)–3(C) illustrate various data memorized in a random-access memory or RAM shown in FIG. 2;

DESCRIPTION OF THE PREFERRED EMBODIMENT

Figure 1:
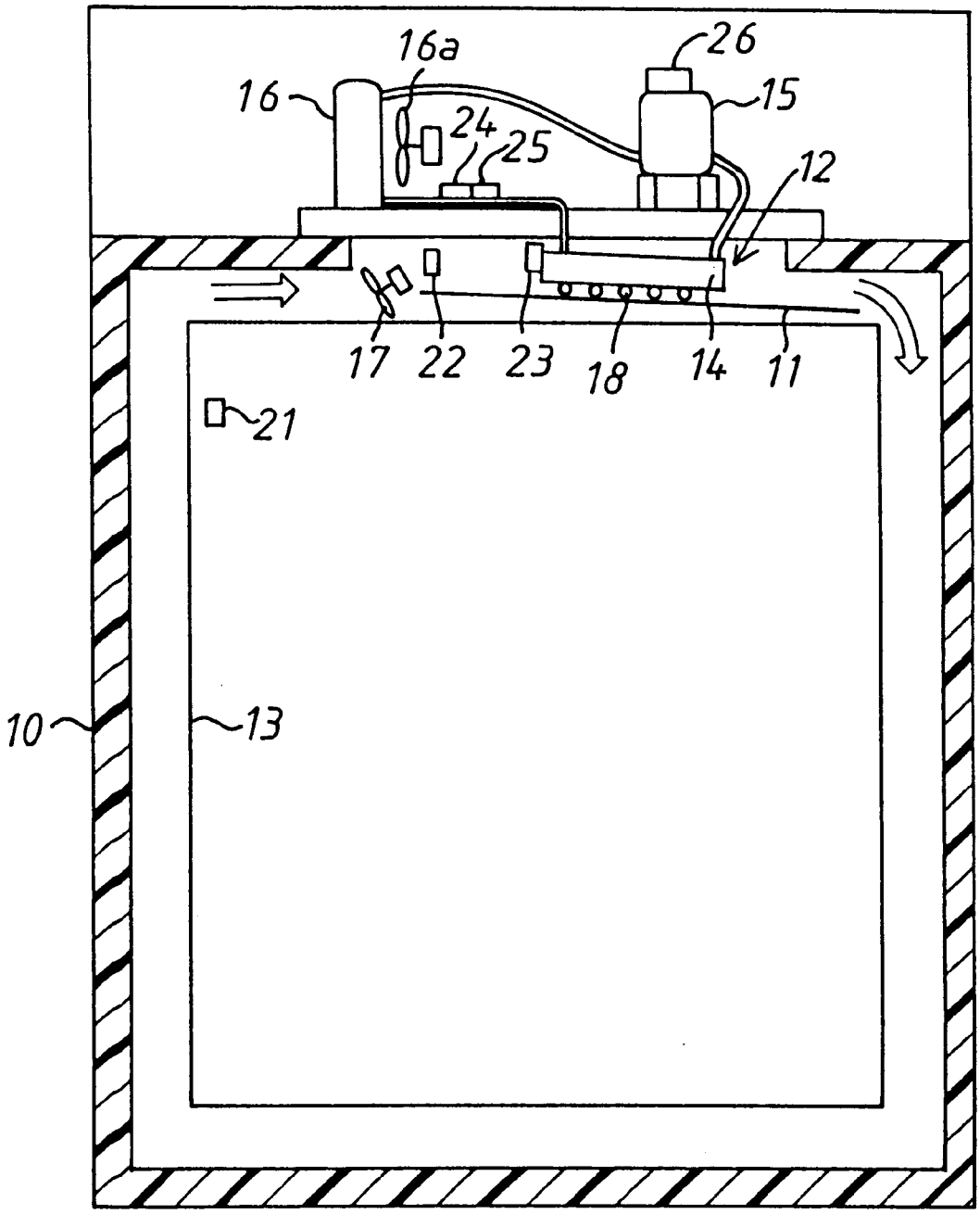
FIG. 1 is a refrigerator equipped with an error monitoring apparatus in accordance with the present invention.

In FIG. 1 of the drawings, there is schematically illustrated a refrigerator equipped with an error monitoring apparatus in accordance with the present invention. The refrigerator is provided with a cooling chamber 12 formed by a partition plate 11 at an upper portion of a housing 10 and an internal storage cabinet 13 located under the cooling chamber 12 to store foodstuffs. An evaporator 14 is mounted on the partition plate 11 to evaporate refrigerant supplied from a compressor 15 and condensed by a condenser 16 thereby to lower the inside temperature of the cooling chamber 12. The evaporated refrigerant is returned to the compressor 15. The condenser 16 is provided with a cooling fan 16*a*. A cooling fan 17 is mounted within the cooling chamber 12 to circulate the cold air from the cooling chamber 12 into a space between the housing 10 and the internal storage cabinet 13. A defrost heater 18 is assembled with the bottom of evaporator 14 for melting frosts adhered thereto.

Figure 2:
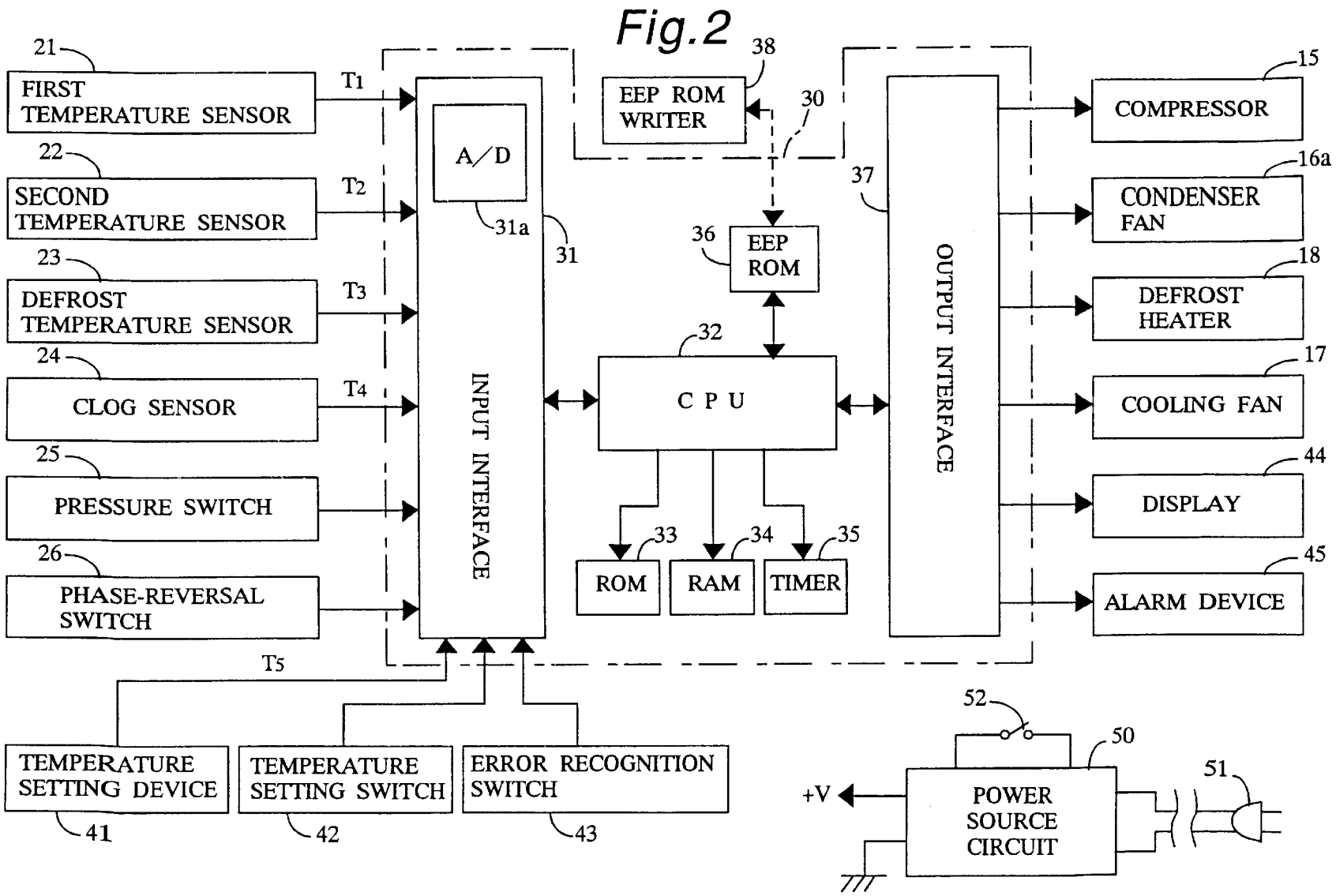
FIG. 2 is a block diagram of an electric controller for the refrigerator shown in FIG. 1.

As shown in FIGS. 1 and 2, the refrigerator is provided therein with a first temperature sensor 21 for detecting an inside temperature of the storage cabinet 13, a second temperature sensor 22 for detecting an inside temperature of the cooling chamber 12, a defrost temperature sensor 23, a clog sensor 24, a pressure switch 25 and a phase-reversal relay switch 26. The first temperature sensor 21 is placed in the internal storage cabinet 13 to detect an inside temperature T1 of the storage cabinet 13 for producing an analog signal indicative of the detected inside temperature T1. The second temperature sensor 22 is placed in the cooling chamber 12 to detect an inside temperature T2 of the cooling chamber 12 for producing an analog signal indicative of the detected inside temperature T2. The defrost temperature sensor 23 is fixed to the evaporator 14 to detect a defrost temperature T3 of evaporator 14 for producing an analog signal indicative of the detected defrost temperature T3.

The clog sensor 24 is disposed in an outlet pipe of condenser 16 to detect a temperature T4 of refrigerant at the outlet side of condenser 16 for producing an analog signal indicative the detected refrigerant temperature T4. The pressure switch 25 is in the form of a normally open switch mounted on the outlet pipe of condenser 16 to be closed when the pressure of refrigerant in the outlet pipe increases in excess. The phase-reversal relay switch 26 is mounted on the compressor 15 to be closed when a connecting condition of a power source line for supply of three phase power to the compressor 15 is in reverse phase.

The sensors 21–24 and switches 25, 26 are connected to an input interface 31 of a microcomputer 30. The input interface 31 includes an analog-to-digital or A/D converter 31*a* which converts the analog signals from sensors 21–24 into digital signals and supplies them to a central processing unit or CPU 32. The input interface 31 is connected to a temperature setting device 41, a temperature setting switch 42 and an error recognition switch 43. The temperature setting device 41 is In the form of a potentiometer for setting the inside temperature of the storage cabinet 13 to a desired temperature T5 to produce an analog signal indicative of the set temperature T5. The temperature setting switch 42 is of the normally open type to switch over the inside temperature T1 of storage cabinet 13 displayed on the Indicator 44 to the set temperature T5 when it is closed. The error recognition switch 43 is of the normally closed type to release an alarm buzzer generated from an alarm device 45 when it is opened.

The microcomputer 30 includes the input interface 32, CPU 32, a ROM 33, a RAM 34, a timer 35, an EEPROM 36 and an output interface 37. The ROM 33 is provided to memorize a program shown by flow charts in FIGS. 4 to 6. The RAM 34 is arranged to memorize variables necessary for execution of the program and has a current error detection file (shown in FIG. 3(A)) for memorizing current error detection flags NER1–NERC indicative of plural current errors (thirteen errors in this embodiment). In the current error detection file, the occurrence of an error is represented by "1". The RAM 34 has a previous error detection file (shown in FIG. 3(B)) for memorizing previous error detection flags OER1–OERC indicative of previous plural errors and a priority order file (FIG. 3(C)) for memorizing error codes E1–EC indicative of currently detected errors in the predetermined order of priority. In this embodiment, the order of priority of plural errors is determined as described below.

EC>EB>EA>E6>E5>E8>E9>E4>E7>E3>E1>E2

The timer 35 is provided to measure lapse of a predetermined time from start of operation for producing a signal Indicative of lapse of the predetermined time. The EEPROM 36 Is connected to an EEPROM writer 38 to memorize data necessary for operation of the refrigerator therethrough. The data may be written into the EEPROM 36 by execution of a program, and the EEPROM S6 may be replaced with an EPROM or a PROM. The output interface 37 is connected to the compressor 15, condenser fan 16*a*, defrost heater 18, cooling fan 17 in the cooling chamber 12, indicator 44 and alarm device 45 to apply a control signal to then in response to instructions from CPU 32. The indicator 44 is in the form of an LED of seven segments or a liquid crystal indicator mounted on the operation panel. The alarm device 45 is also mounted on the operation panel to issue an alarm buzzer. The electric controller for the refrigerator is provided with a power source circuit 50 which is connected to a source of electric power through a connector 51 to apply a power-supply voltage +V to the electric parts of the controller when a power source switch 52 is closed.

Figure 7:
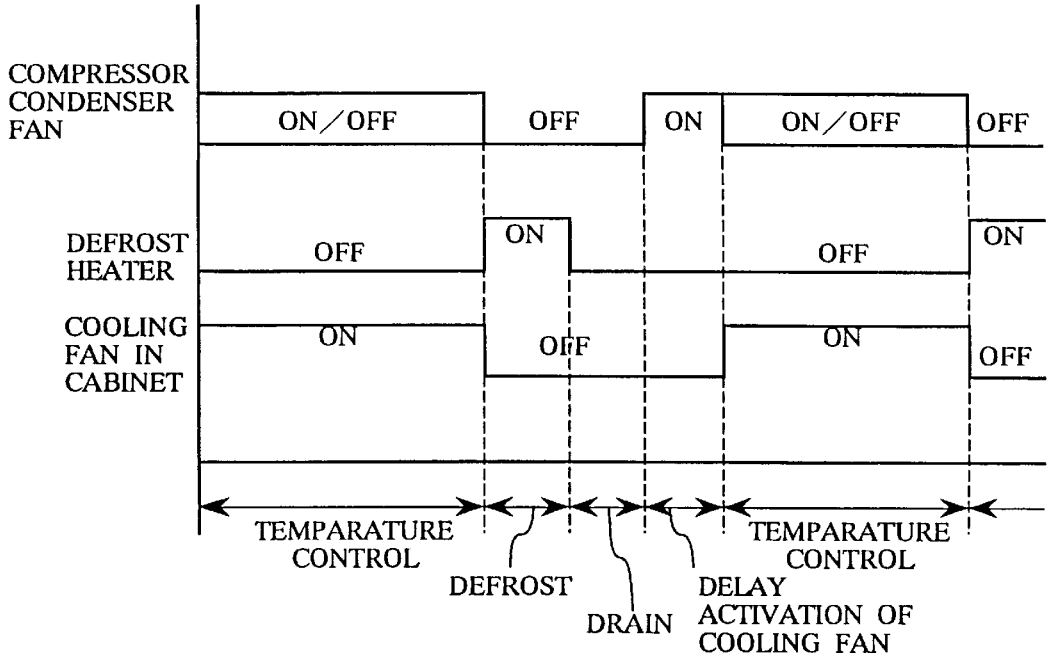
FIG. 7 illustrates a mode of operation of the refrigerator.
Figure 8:
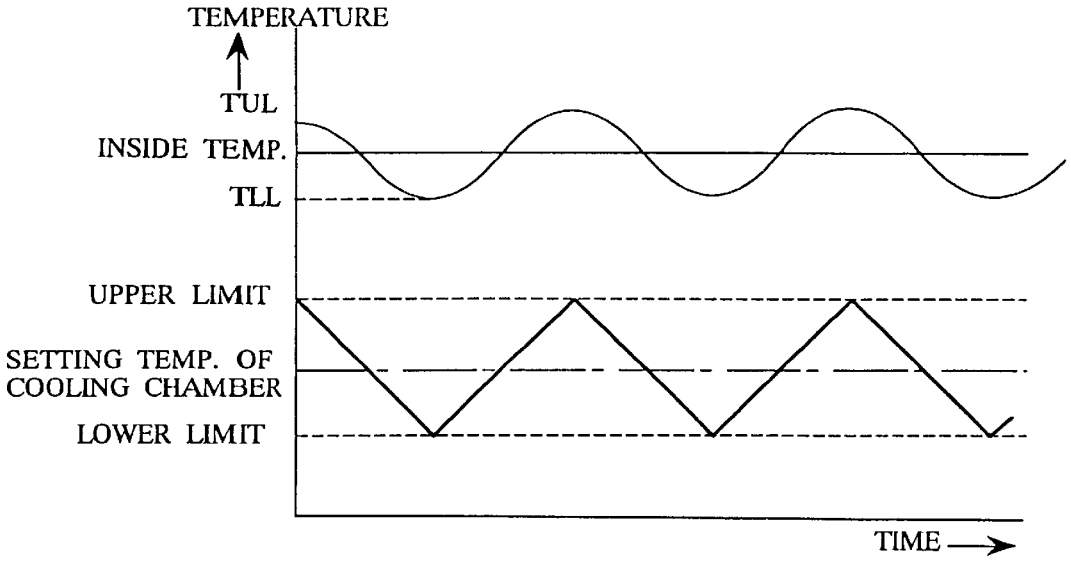
FIG. 8 is a time chart illustrating variation of an inside temperature of a storage cabinet In the refrigerator and an inside temperature of a cooling chamber in the refrigerator.

Hereinafter, operation of the refrigerator will be described with reference to a flow chart shown in FIG. 4. When the power source switch 52 is closed, the electric parts of the controller are supplied with the power-supply voltage +V from the power source circuit 50. This causes the CPU 32 to start execution of the program shown by the flow chart in FIG. 4 at step 100. At step 102, the CPU 32 initializes variables necessary for execution of the program to repeat execution of processing at step 104 to 116. At step 104, the CPU 32 executes a temperature control routine. During execution of the temperature control routine. The CPU 32 sets a cooling temperature T6 slightly lower than a temperature T5 set by the temperature setting device 41. When an inside temperature T2 of cooling chamber 12 detected by the second temperature sensor 22 becomes higher than an upper limit temperature defined by addition of a predetermined small value to the cooling temperature T6, the compressor 15 and condenser fan 16*a* are activated under control of the CPU 32 to lower the inside temperature T2 of cooling chamber 12. When the inside temperature T2 detected the second temperature sensor 22 becomes lower than a lower limit temperature defined by subtraction of the predetermined small temperature from the cooling temperature T6, the compressor 15 and condenser fan 16*a* are deactivated under control of the CPU 32 to rise the inside temperature T2 of cooling chamber 12. With such control of the compressor 15 and condenser fan 16*a*, the inside temperature T2 of cooling chamber 12 is maintained approximately at the cooling temperature T6. In addition, the cooling fan 17 for the storage cabinet 13 is maintained in activated condition during execution of the temperature control routine to maintain the inside temperature of storage cabinet 13 approximately at a temperature between a lower limit temperature $T_{LL}$ and an upper limit temperature $T_{UL}$. (see FIGS. 7 and 8)

When the program proceeds to step 106, the CPU 32 executes a defrost control routine for defrost of the evaporator 21. During execution of the defrost control routine, the CPU 32 cooperates with the timer 35 to deactivate the compressor 15, condenser fan 16*a* and cooling fan 17 for the storage cabinet 13 at each lapse of the predetermined time (for example, six hours) and to activate the defrost heater 18. Thus, the evaporator 21 is warmed to melt frosts adhered thereto. When the temperature of evaporator 14 detected by the defrost temperature sensor 23 becomes higher than a defrost termination temperature, the defrost heater 18 is deactivated and maintained in its deactivated condition under control of the CPU 23 to discharge the melted frosts to the exterior until a timer count value for drain incremented by the timer 35 becomes a predetermined value.

After execution of the defrost control routine at step 106. The CPU 32 executes at step 108 a temperature display control routine for activating the indicator 44 to display the inside temperature T1 of the storage cabinet 13 and the set temperature T5 thereon. During execution of the temperature display control routine, the inside temperature T1 of the storage cabinet 13 detected by the first temperature sensor 21 is displayed on the indicator 44. When the temperature setting switch 42 is operated, the set temperature T5 is displayed on the indicator 44 In stead of the inside temperature T1 of storage cabinet 13. In the occurrence of an error in the refrigerator, the indicator 44 is activated under control of the CPU 32 to display either one of error codes E1–EC prior to display of the inside temperature T1 of storage cabinet 13 or the set temperature T5 as will be described later.

During execution of processing at step 104 to 108 for control of the refrigerator, the CPU 32 detects at step 110 the occurrence of plural errors in the refrigerator and activates the indicator 44 and alarm device 45 to display a result of the detection and to issue an alarm buzzer. At step 110, the CPU 32 detects the occurrence of plural errors in the refrigerator based on detection signals from sensors 21–24, switches 25, 26 and the count value incremented by the timer 35 and causes the RAM 34 to memorize a result of the detection in the current error detection file (see FIG. 3(A)).

Abnormality in high temperature (E1):

If the inside temperature T1 of the storage cabinet 13 is maintained at a higher temperature in 10° C. than the set temperature T5 for more than two hours, the CPU 32 sets the current error detection flag NER1 as "1" indicative of abnormality in high temperature. If the inside temperature T1 of the storage cabinet 13 becomes the lower limit temperature $T_{LL}$ after the current error detection flag NER1 was set as "1", the CPU 32 determines the fact that the abnormality in high temperature was automatically eliminated and resets the current error detection flag NER1 to "0".

Abnormality in low temperature (E2):

If the inside temperature T1 of the storage cabinet 13 is maintained at a lower temperature in 5° C. than the set temperature T5 for more than one hour, the CPU 32 sets the current error detection flag NER2 as "1" indicative of abnormality in low temperature. If the inside temperature T1 of the storage cabinet 13 rises up to the upper limit temperature $T_{UL}$ after the current error detection flag NER2 was set as "1", the CPU 32 confirms the fact that the abnormality in low temperature was automatically eliminated and resets the current error detection flag NER2 to "0".

Abnormality in defrost (E3):

If the defrost control is terminated by finish of measurement of a heating time (for example, one hour), the CPU 32 determines abnormality in defrost and sets the current error detection flag NER3 as "1".

Abnormality in high pressure (E4);

When the pressure switch 25 was turned on, the compressor 15 is deactivated. After lapse of five minutes, the condition of pressure switch 25 is inspected. If the pressure switch 25 is already turned off, the refrigerator is returned to normal operation. If such control for deactivation of the compressor 15 Is repeated more than five times within one hour, the CPU 32 sets the current error detection flag NER4 as "1" indicative of abnormality in high pressure. If the control for deactivation of the compressor 15 was not repeated more than five times within one hour, the CPU 32 makes a count value of the control times clear upon lapse of one hour. When the pressure switch 25 is maintained in its closed position, The compressor 15 is maintained in its deactivated condition.

Abnormality in second temperature sensor 22 (E5):

If the inside temperature T2 of cooling chamber 12 is lower than a predetermined value for detection of disconnection, the CPU 32 sets the current error detection flag NER5 as "1" indicative of disconnection of the temperature sensor 22. If the inside temperature T2 of cooling chamber 12 becomes higher than the predetermined value for detection of disconnection after the current error detection flag NER5 was set as "1", the CPU 32 determines the fact that the abnormality in temperature sensor 22 was automatically eliminated and resets the current error detection flag NER5 to "0". If the inside temperature T2 of cooling chamber 12 is maintained higher than a predetermined value for detection of a short circuit for more than ten minutes, the CPU 32 sets the current error detection flag NER5 as "1" indicative of a short circuit of the temperature sensor 22. If the inside temperature T2 of cooling chamber 12 becomes lower than the predetermined value for detection of the short circuit after the detection flag NER5 was set as "1", the CPU 32 determines the fact that the abnormality in temperature sensor 22 was automatically eliminated and resets the detection flag NER5 to "0". The detection of the short circuit in second temperature sensor 22 is not effected for one hour unless the power source switch 52 is closed in a condition where the temperature setting switch 42 is maintained in its closed position. When the power source switch 52 is closed in a condition where the temperature setting switch 42 was closed, the detection of the short circuit in temperature sensor 22 is effected immediately after the power source switch 52 was closed.

Abnormality in phase-reversal connection (E6):

When the phase-reversal switch 26 is maintained in its closed position, the CPU 32 sets the current error detection flag NER6 as "1" indicative of abnormality in phase-reversal connection of the compressor 15. If the phase-reversal switch 26 is turned off after the detection flag NER6 was set as "1", the CPU 32 resets the detection flag NER6 to "0".

Abnormality in clog sensor 24 (E7):

If the refrigerant temperature T4 detected by the clog sensor 24 is maintained higher than a predetermined temperature for more than five minutes, the CPU 32 sets the current error detection flag NER7 as "1" indicative of abnormality in clog sensor 24. If the refrigerant temperature T4 becomes lower than the predetermined temperature after the detection flag NER7 wan set as "1", the CPU 32 confirms the fact that the abnormality in clog sensor 24 was automatically eliminated and resets the detection flag NER7 to "0".

Abnormality in defrost temperature sensor 23 (E8):

If the defrost temperature T3 detected by sensor 23 is lower than a predetermined value for detection of disconnection, the CPU 32 sets the current error detection flag NER8 as "1" indicative of disconnection of the defrost temperature sensor 23. If the defrost temperature T3 becomes higher than the predetermined value for detection of disconnection after the detection flag NER8 was set as "1", the CPU 32 determines the fact that the abnormality in temperature sensor 23 was automatically eliminated and resets the detection flag NER8 to "0". If the defrost temperature T3 is higher than a predetermined value for detection of a short circuit for ten minutes, the CPU 32 sets the detection flag NER8 as "1" indicative of a short circuit in defrost temperature sensor 23. If the defrost temperature T3 becomes lower than the predetermined value for detection of a short circuit after the detection flag NER8 was set as "1", the CPU 32 determines the fact that the abnormality in defrost temperature sensor 23 was automatically eliminated and reset the detection flag NER8 to "0". Provided that the detection of abnormality in defrost temperature sensor 23 is not effected within one hour unless the power source switch 52 is closed in a condition where the temperature setting switch 42 is being turned on. When the power source switch is turned on in a Condition where the temperature setting switch 42 is being turned on the detection of abnormality in defrost temperature sensor 23 is effected immediately after the power source switch 52 is closed.

Abnormality i clog sensor 24 (E9):

If the refrigerant temperature T4 detected by clog sensor 24 is lower than a reference value for detection of disconnection, the CPU 32 sets the current error detection flag NER9 as "1" indicative of disconnection in the clog sensor 24. When the refrigerant temperature T4 becomes higher than the reference value for detection of disconnection after the detection flag NER9 was set as "1", the CPU 32 confirms the fact that the abnormality in clog sensor 24 was eliminated and resets the detection flag NER9 to "0". If the refrigerant temperature T4 is higher than a reference value for detection of a short circuit for more than ten minutes, the CPU 32 sets the detection flag NER9 as "1" indicative of a short circuit in clog sensor 24. When the refrigerant temperature T4 becomes lower than the reference value for detection of a short circuit after the detection flag NER9 was set as "1", the CPU 32 confirms the fact that the abnormality in clog sensor 24 was automatically eliminated and resets the detection flag NER9 to "0".

Abnormality in data input to the EEPROM (FA):

If a written data is different from a data read out from the EEPROM 38, the CPU 32 sets the current error detection flag NERA as "1" indicative of abnormality in data input to the EEPRON 38. When the written data coincides with the data read out from the EEPROM 38 after the detection flag was set as "1", the CPU 32 determines the fact that the data input to the EEPROM 38 became normal and resets the detection flag NERA to "0".

Abnormality in the A/D converter (EB):

If the analog signals from sensors 21–24 may not be converted into digital signals in 1 msec, the CPU 32 sets the current error detection flag NERB as "1" indicative of abnormality in the A/D converter 31*a*. When the analog signals are converted into digital signals in 1 msec after the detection flag NERB was set as "1", the CPU 32 determines the fact that the A/D converter 31*a* became normal and resets the detection flag NERB to "0".

Abnormality in output of the EEPROM (EC):

The data written into the EEPROM 36 is periodically read out by the CPU 32 to compare with the data previously transferred into the RAM 34 from the EEPROM 36. If the former data is different from the latter data, the CPU 32 sets the current error detection flag NERC as "1" indicative of abnormality in output of the EEPROM 36. When the former data coincides with the latter data after the detection flag NERC was set as "1", the CPU 32 determines the fact that the read-out of the data from the EEPROM 36 became normal and resets the detection flag NERC to "0".

Figure 5:
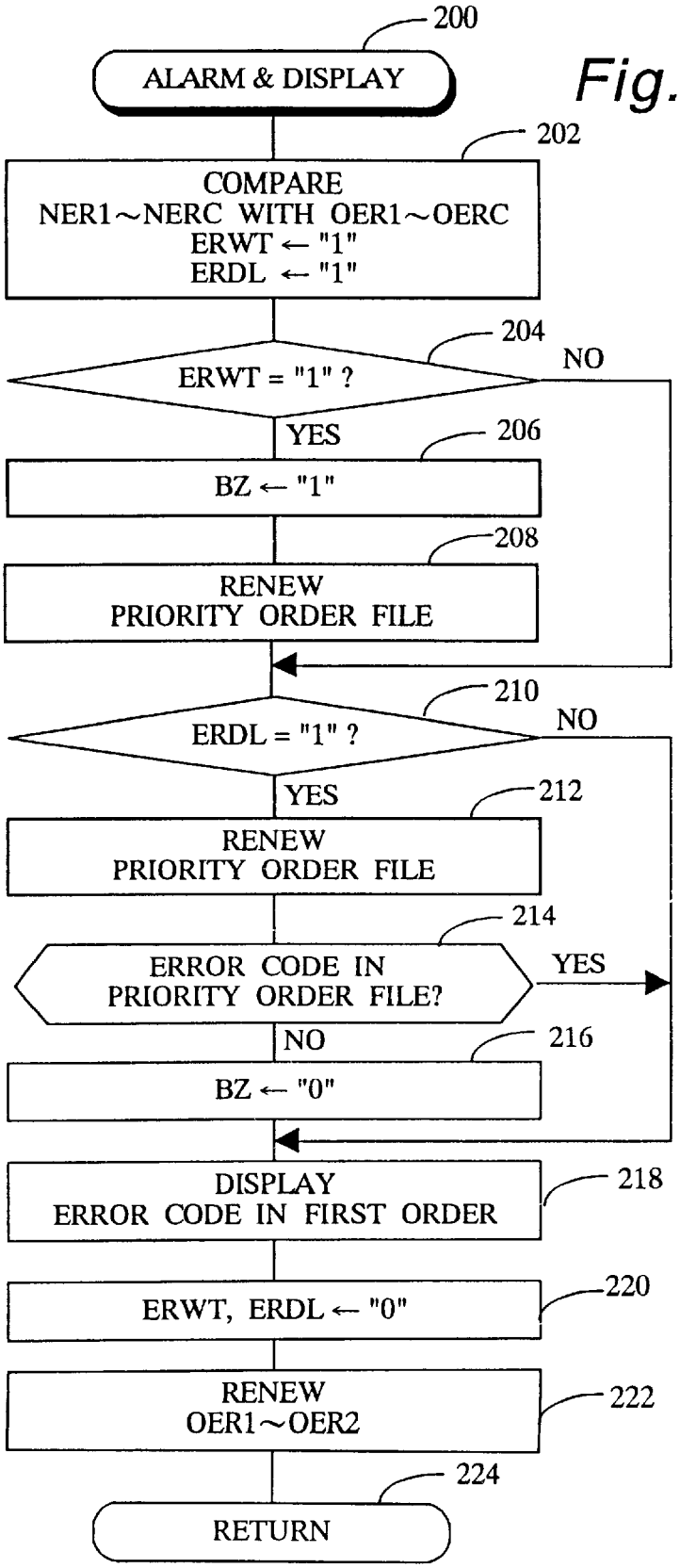
FIG. 5 is a flow chart of an alarm and display routine shown in FIG. 4.
Figure 6:
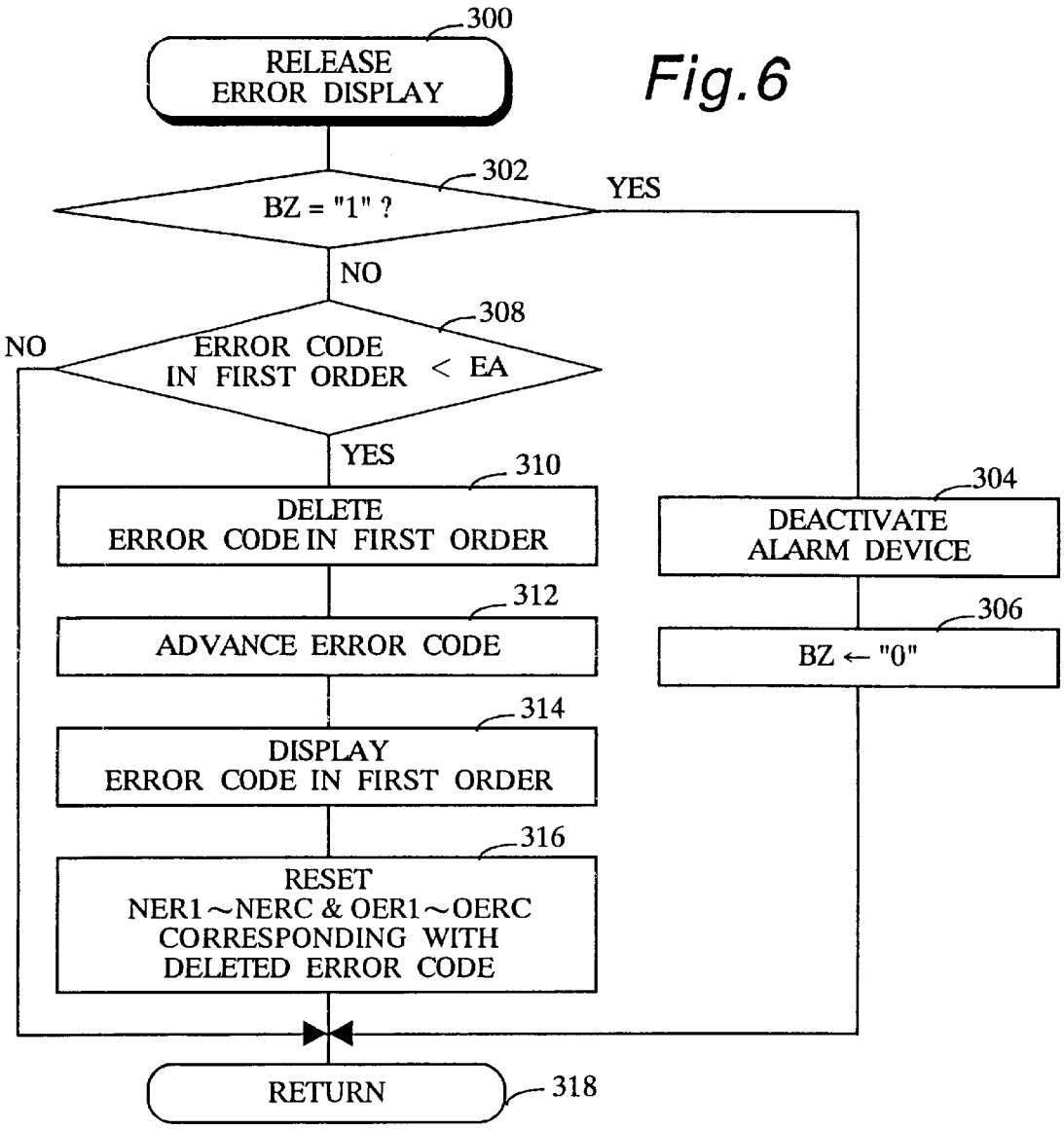
FIG. 6 is a flow chart of an error display cancel routine shown in FIG. 4.

After execution of processing at step 110, the CPU 32 executes at step 112 an alarm and display routine shown by a flow chart in FIG. 5. When the program proceeds to step 112, the CPU 32 starts at step 200 of FIG. 5 to execute the alarm and display routine and compares at step 202 the current error detection flags NER1–NERC in the current error detection file (see FIG. 3(A)) with previous error detection flags OER1–OERC in the previous error detection file (see FIG. 3(B)) to set an abnormal flag ERWT or a normal flag ERDL as "1" based on a result of the comparison. At an initial stage, all the previous error detection flags OER1–OERC each are set as an initial value "0". When the refrigerator is normal in operation, all the current error detection flags each are set as "0". In such a condition, the abnormal flag ERWT and normal flag ERDL each are maintained as "0", and the CPU 32 determines a "No" answer respectively at step 204 and 210.

If there occurs an error in the refrigerator, either one of the current error detection flags NER1–NERC corresponding with the error is set as "1", while either one of the previous error detection flags OER1–OERC corresponding with the error Is maintained as "0". In such an instance, the CPU 32 detects at step 202 the occurrence of the error and sets the abnormal flag ERWT as "1". As a result, the CPU 32 determines a "Yes" answer at step 204, activates at step 206 the alarm device 45 to issue an alarm buzzer, and sets an alarm flag BZ as "1".

After execution of processing at step 206, the CPU 32 writes an error code EX (X=1–C) indicative of the occurrence of the error into the priority order file (see FIG. 3 (C)). If plural error codes E1–EC are written into the priority order file as a result of the writing, the newly written error code EX is aligned with the plural error codes in the order of priority. Thus, the error codes E1–EC indicative of plural errors in the refrigerator are memorized in the priority order file in the order of priority.

When the occurrence of the error is eliminated. The CPU 32 sets one of the current error detection flags NER1–NERc corresponding with the error as "0", while one of the previous error detection flags OER1–OERC corresponding with the error Is maintained as "1". In this instance, the CPU 32 sets at step 202 the normal flag ERDL as "1". As a result, the CPU 32 determines a "Yes" answer at step 210, deletes at step 212 the error code EX (X=1–C) indicative of the eliminated error from the priority order file and replaces the error codes E1–EC in the order of priority in the priority file. When the other errors are eliminated, the CPU 32 deletes at 212 the error codes E1–EC indicative of the eliminated errors to renew the priority order file. When all the error codes E1–EC are deleted from the priority order file, the CPU 32 determines a "No" answer at step 214, deactivates the alarm device 45 at step 216 and resets the alarm flag BZ to "0".

If either one of the error codes is memorized in the priority order file after processing at step 204–216. The CPU 32 activates the indicator 44 to display the error code memorized in the first order of the priority file. When any error code is not memorized in the priority order file, the CPU 32 controls the indicator 44 to display the inside temperature T1 of the storage cabinet 13 or the set temperature T5. After processing at step 218, the CPU 32 sets at step 220 the abnormal flag ERWT and normal flag ERDL as "0" respectively, renews at step 222 the previous error detection flags OER1–OERC in the previous error detection file with the current error detection flags NER1–NERC in the current error detection file and finishes at step 224 the execution of the alarm and display routine.

Figure 4:
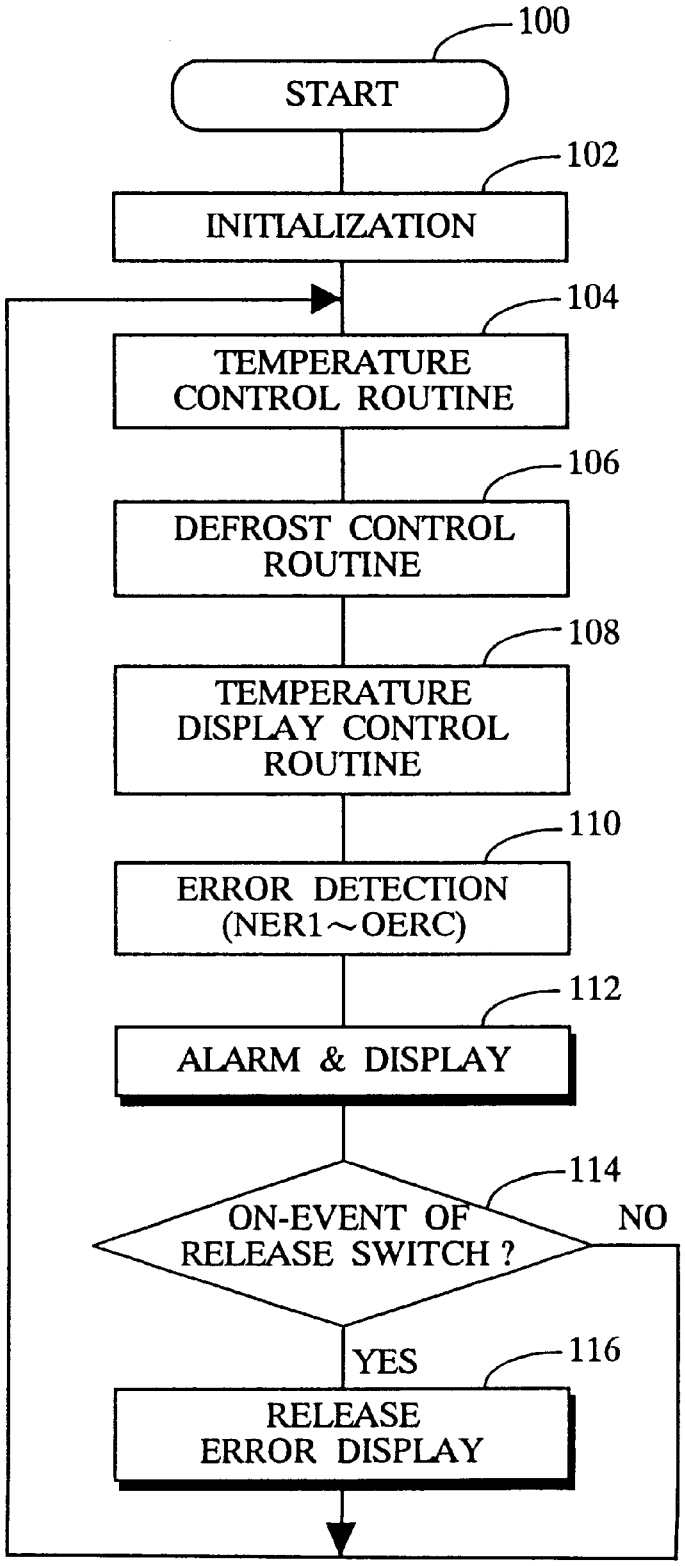
FIG. 4 is a flow chart of a control program executed by a central processing unit or CPU shown in FIG. 2.

When the error recognition switch 43 is turned on in a condition where either one of the error codes is displayed on the indicator 44, the CPU 32 determines a "Yes" answer at step 114 of FIG. 4 and causes the program to proceed to step 116 for execution of an error display cancel routine. As shown by a flow chart in FIG. 6, the CPU 32 starts at step 300 to execute the error display cancel routine and determines at step 302 whether the alarm flag BZ is "1" or not. If the answer at step 302 is "Yes", the CPU 32 deactivates the alarm device 45 at step 304 and resets at step 306 the alarm flag BZ to "0".

When the error recognition switch 43 is turned on again after deactivation of the alarm device 45, the error display cancel routine is executed again by the CPU 32. As in this instance, the alarm flag BZ is set as "0", the CPU 32 determines a "No" answer at step 302 and causes the program to proceed to step 308. At step 308, the CPU 32 determines whether the error code in the first order of the priority file is lower in priority than the error code EA or not. If the answer at step 308 is "Yes", the CPU 32 causes the program to proceed to step 310 to 316. Thus, the CPU 32 deletes at step 310 the error code memorized in the first order of the priority file and advances at step 312 the remaining error codes in the priority order file. Thereafter, the CPU 32 controls the Indicator 44 at step 314 to display the error code currently memorized in the first order of the priority file. When the program proceeds to step 316, the CPU 32 resets the error detection flags NER1–NERC and OER1–OERC corresponding with the deleted error codes to "0" respectively and makes the count value used for detection of the deleted error codes clear. When the error recognition switch 43 is further turned on, the CPU 32 repeats execution of the processing at step 310 to 316 until all the error codes in the priority order file are deleted.

When the error code memorized in the first order of the priority file is higher in order than the error code EA, the CPU 32 determines a "No" answer at step 308 and finishes at step 318 execution of the error display cancel routine. As a result, the error codes Indicative of the errors i n the EEPROM 36 may not be deleted even if the error recognition switch 43 is turned on. In this instance, the display of the error codes on the indicator 45 may not b e changed.

From the above description, it will be understood that in the occurrence of an error in the refrigerator, the error is detected by processing at step 110, 202 to issue an alarm buzzer by processing at step 206. In detection of plural errors, the error codes E1–EC Indicative of the detected plural errors are memorized In the priority file stored in the RAM 34 in the order of priority, and the error code memorized in the first order of the priority file is displayed on the indicator 44.

When a user or an inspector in charge for shipment turns on the error recognition switch 43, the alarm buzzer is stopped by processing at step 302 and 304. When the error recognition switch 43 is further turned on by the user or Inspector during deactivation of the alarm device 45, the error codes memorized in the priority order file are successively deleted in the order of priority by processing at step 310–316, and the display of the error codes is successively switched over in the order of priority. Thus, in the occurrence of plural errors In the refrigerator, the user or inspector Is released from the unpleasant alarm buzzer by operation of the error recognition switch 43, and all the errors can be recognized by the user or inspector in the order of importance.

In addition, even if the error recognition switch 43 is turned on by the user or inspector in a condition where the error code EA, EB or EC is displayed on the indicator 44, the error codes in the priority order file may not be deleted, and the display of the error codes may not be switched over. This is useful to remain the display of serious errors for operation of the refrigerator such as errors in the EEPROM 36, A/D converter 31*a* represented by the error codes. It is, therefore, able for the user or inspector to recognize the occurrence of serious errors in the refrigerator for avoiding restart of the refrigerator in a serious condition for operation.

What is claimed is:

1. An error monitoring apparatus for a refrigeration device, said error monitoring apparatus comprising:

detection means for detecting an occurrence of a plurality kinds of errors in operation of the refrigeration device;

an error recognition switch connected to said detection means for recognizing each kind of error of the plurality of kinds of errors detected by said detection means;

memory means connected to said detection means for memorizing the errors detected by said detection means in a priority order file in a predetermined order of priority;

indication means connected to said memory means for successively displaying the errors memorized in the priority order file when said error recognition switch is operated;

display control means connected to said indication means and said error recognition switch for controlling said indication means to display either one of the errors memorized in a first order of the priority order file at each time when said error recognition switch is operated; and memory control means for controlling said memory means to delete the error in the first order of the priority order file therefrom and advance the order of remaining errors in the priority order file when said error recognition switch is operated in a condition where the error in the first order is being displayed on said indication means.

2. An error monitoring apparatus as claimed in claim 1, further comprising alarm means for generating an alarm buzzer when the occurrence of a plurality kinds of errors is detected by said detection means and alarm control means for deactivating said alarm means when said error recognition switch is operated in a condition where the error in the first order is being displayed on said indication means.

3. An error monitoring apparatus as claimed in claim 1, wherein said display control means comprises means for controlling said indication means to maintain the display of the error memorized in the first order of the priority order file even if said error recognition switch is operated when the error in the first order is higher in order than an error indicative of a serious abnormal condition for operation of the refrigeration device.

* * * * *